US009443634B2

(12) United States Patent
Fairbairn

(10) Patent No.: US 9,443,634 B2
(45) Date of Patent: Sep. 13, 2016

(54) ATMOSPHERIC ELECTRON PARTICLE BEAM GENERATOR

(75) Inventor: Thomas Edward Fairbairn, Maumee, OH (US)

(73) Assignee: FRIPRO ENERGY, LLC, Maumee, OH (US)

( * ) Notice: Subject to any disclaimer, the term of this patent is extended or adjusted under 35 U.S.C. 154(b) by 1883 days.

(21) Appl. No.: 12/544,290

(22) Filed: Aug. 20, 2009

(65) Prior Publication Data

US 2010/0043729 A1 Feb. 25, 2010

Related U.S. Application Data

(60) Provisional application No. 61/090,500, filed on Aug. 20, 2008, provisional application No. 61/209,198, filed on Mar. 4, 2009.

(51) Int. Cl.

| | |
|---|---|
| ***H01J 27/00*** | (2006.01) |
| ***G21K 5/04*** | (2006.01) |
| ***F22B 1/28*** | (2006.01) |

(52) U.S. Cl.

CPC ..... *G21K 5/04* (2013.01); *F22B 1/281* (2013.01)

(58) Field of Classification Search

CPC ..... G21K 5/04; F22B 1/281
USPC ..... 250/493.1
See application file for complete search history.

(56) References Cited

U.S. PATENT DOCUMENTS

| | | | | |
|---|---|---|---|---|
| 207,753 A | | 9/1878 | Lugo | |
| 2,648,015 A | | 8/1953 | Greenfield et al. | |
| 3,300,561 A | | 1/1967 | Foex | |
| 3,309,491 A | | 3/1967 | Jacobs | |
| 3,364,387 A | | 1/1968 | Anderson | |
| 3,648,015 A | | 3/1972 | Fairbairn | |
| 3,692,973 A | | 9/1972 | Oku et al. | |
| 3,894,209 A | * | 7/1975 | Fairbairn | H01J 33/00 219/121.47 |
| 3,947,654 A | | 3/1976 | Fairbairn | |
| 4,147,916 A | | 4/1979 | Fairbairn | |
| 4,473,349 A | | 9/1984 | Kumatsu | |
| 4,519,770 A | | 5/1985 | Kesselring et al. | |

(Continued)

OTHER PUBLICATIONS

International Search Report and Written Opinion mailed Dec. 18, 2009 in PCT/US2009/054382.

(Continued)

*Primary Examiner* — Joseph L Williams
(74) *Attorney, Agent, or Firm* — MacMillan, Sobanski & Todd, LLC

(57) ABSTRACT

Provided is an atmospheric electron particle beam nozzle, with a nozzle body having a lumen disposed therethrough; an electrode that is disposed within the lumen, optionally concentrically with the nozzle body, to define an output chamber within the lumen that encompasses the electrode. Also provided is an atmospheric electron particle beam system that provides: a nozzle, that supplies a nozzle body having a lumen disposed therethrough; an electrode disposed within the lumen, optionally concentrically with the nozzle body, to define an output chamber; an RF generator that is in communication with a transformer having a number of turns and connected to a vacuum variable capacitor, and connected electrically to the electrode; and a fluid source that supplies the nozzle with a fluid. Also herein is a method of projecting an electron beam, by projecting an electron charged fluid sheath over a distance, and projecting the electron beam within the sheath.

15 Claims, 8 Drawing Sheets

(56) References Cited

U.S. PATENT DOCUMENTS

| | | | |
|---|---|---|---|
| 4,543,940 | A | 10/1985 | Krill et al. |
| 5,041,732 | A | 8/1991 | Saito |
| 6,936,971 | B2 | 8/2005 | Chukanov |
| 2006/0219681 | A1 | 10/2006 | Reddy et al. |

OTHER PUBLICATIONS

International Preliminary Report on Patentability dated Mar. 3, 2011 from corresponding PCT/US2009/054382.

* cited by examiner

FIG. 6

| The Electromagnetic Spectrum | | | |
|---|---|---|---|
| ***Wave*** | **λ, meters** | **frequency, Hz** | **Energy, eV** |
| AM Radio | $10^{2}$ | 1 MHz | $10^{-9}$ eV |
| FM, Television | 1 | 100 MHz | $10^{-7}$ eV |
| Radar | 0.1 | 1 GHz | $10^{-6}$ eV |
| Microwaves | $10^{-2}$ | $10^{10}$ Hz | $10^{-5}$ eV |
| Infrared | $10^{-5}$ | $10^{13}$ Hz | $10^{-2}$ eV |
| Visible | $10^{-7}$ | $10^{15}$ Hz | 1 eV |
| UV | $10^{-8}$ | $10^{16}$ Hz | 10 eV |
| X-rays | $10^{-10}$ | $10^{18}$ Hz | 1 keV |
| γ-rays | $10^{-13}$ | $10^{21}$ Hz | 1 MeV |

ATMOSPHERIC ELECTRON PARTICLE BEAM GENERATOR

CROSS-REFERENCE TO RELATED APPLICATIONS

The present application is claiming priority of, and incorporating herein by reference in its entirety, U.S. Provisional Patent Application Ser. No. 61/090,500, filed on Aug. 20, 2008. The present application is also claiming priority of, and incorporating herein by reference in its entirety, U.S. Provisional Patent Application Ser. No. 61/209,198, filed Mar. 4, 2009.

BACKGROUND OF THE INVENTION

1. Field of the Invention

The present disclosure relates to particle beams, and to a nozzle for directing a radio frequency (RF) atmospheric electron particle beam (AEPB) atmospheric electron charged cloud. The present disclosure relates also to methods of heating targets, such as boilers, with such beams without generating undesirable products of combustion, and without unwanted RF emissions. The AEPB of the present disclosure comprises electrons. The AEPB, due to its high energy output, has characteristics and applications unavailable to the background art.

2. Description of the Related Art

Boilers typically rely on combustion of a fuel as a source of heat for generating steam. Such combustion liberates pollutants and greenhouse gases, such as oxides of sulfur, oxides of nitrogen, carbon monoxide, carbon dioxide, soot, smoke, ozone, fly ash, heavy metals, and the like. Environmental concerns make the liberation of these pollutants undesirable and for this reason combustion-dependent boilers of the background art must be fitted with expensive and complex means for remediating the pollutants.

The present disclosure overcomes the disadvantages of the prior art, and makes it possible to operate a boiler with a reduction or elimination of environmentally-undesirable combustion products typically associated with combustion of fuels. According to the present disclosure, this is achieved by heating the boiler using an atmospheric electron particle beam that is not dependent upon combustion. Rather, according to the present disclosure, fuels are dissociated non-combustively in an electron charged fluid sheath, thereby liberating energy from the fuels while substantially avoiding problematic emissions. There is, for example, no smoke or pollutant gas produced from such dissociation. The absence of combustion means also that a boiler driven by an atmospheric electron particle beam need not be supplied with oxygen.

SUMMARY

An atmospheric electron particle beam (AEPB) nozzle having a nozzle body with a lumen disposed therethrough, and that has an electrode that is disposed within the lumen to define an output chamber within the lumen that encompasses the electrode. In a preferred embodiment, the electrode is disposed concentrically within the output chamber. In a further embodiment, the electrode need not be disposed concentrically with the output chamber.

There is provided an atmospheric electron particle beam (AEPB) system that has an atmospheric electron particle beam nozzle that comprises: a nozzle body having a lumen disposed therethrough; and an electrode that is disposed within the lumen to define an output chamber within the lumen that encompasses the electrode. Preferably, though optionally, the electrode is disposed concentrically within the nozzle body. The system provides as well an RF generator that is in communication with a transformer having a number of turns, and the transformer is connected to a vacuum variable capacitor, and connected electrically to the electrode of the nozzle. The system includes also a fluid source that is in fluid communication with the nozzle, and that supplies the nozzle with a fluid, e.g., atmospheric air, an inert gas, an atmospheric hydrocarbon. In a preferred embodiment, the RF generator is operated at a frequency of between about $10^5$ Hz to about $10^9$ Hz, preferably about 13.56 MHz±0.005%, most preferably at 13.56 MHz.

Also herein is a method of heating a boiler system by emitting an atmospheric electron particle beam, a portion of which is disposed within an electron charged fluid sheath, from an atmospheric electron particle beam nozzle; contacting a ceramic tube or other radiant heating device disposed within a boiler with the atmospheric electron particle beam, thereby heating the ceramic tube; and heating water disposed within the boiler. Optionally, the boiler is vertically oriented.

This disclosure provides a method of projecting an electron beam, by projecting an electron charged fluid sheath over a distance, and projecting the electron beam within the electron charged fluid sheath. In an embodiment, the electron charged fluid sheath and the electron beam are driven (modulated) by RF input at a frequency between about $10^5$ to about $10^9$ Hertz.

Further there is provided a method of projecting an electron beam by: encompassing an electrode within a nozzle body; supplying a fluid into the nozzle body; and applying an RF input to the electrode. The RF input to the electrode causes the electron beam to be emitted from the electrode, and the RF input causes the fluid to form an electron charged fluid that sheathes the electron beam.

The present disclosure provides a radio frequency inductive capacitive transformer (RFIC) that comprises a coil that is a primary winding and that has a plurality of turns. A first turn of the plurality of turns is a primary circuit, and second and further turns of the coil are a secondary circuit. The RFIC receives RF input at a first voltage and a first current, and produces RF output at a second voltage and a second current. In an embodiment, each of the second and further turns of the plurality of turns effects an increase of the second voltage and a decrease of the second current. With sufficient turns it is possible to achieve a suitable RF output voltage and current, which can be conveyed by a connection to an AEPB according to the present disclosure. The transformer receives an input of fluid and produces an output of electron charged fluid.

A preferred frequency of the RF input is about 5 to 80 MHz though any frequency between about $10^5$ to $10^9$ Hertz is suitable. A frequency of 13.56 MHz±0.005% is especially preferred. An operable combination of voltage and current of the RF input is a voltage of about 2 kV to 20 kV, preferably 5 kV and a current of from about 1 Ampere to about 10 Amperes.

BRIEF DESCRIPTION OF THE DRAWINGS

FIG. 6 is a table of the electromagnetic spectrum.

DETAILED DESCRIPTION OF THE PREFERRED EMBODIMENTS

Figure 1:
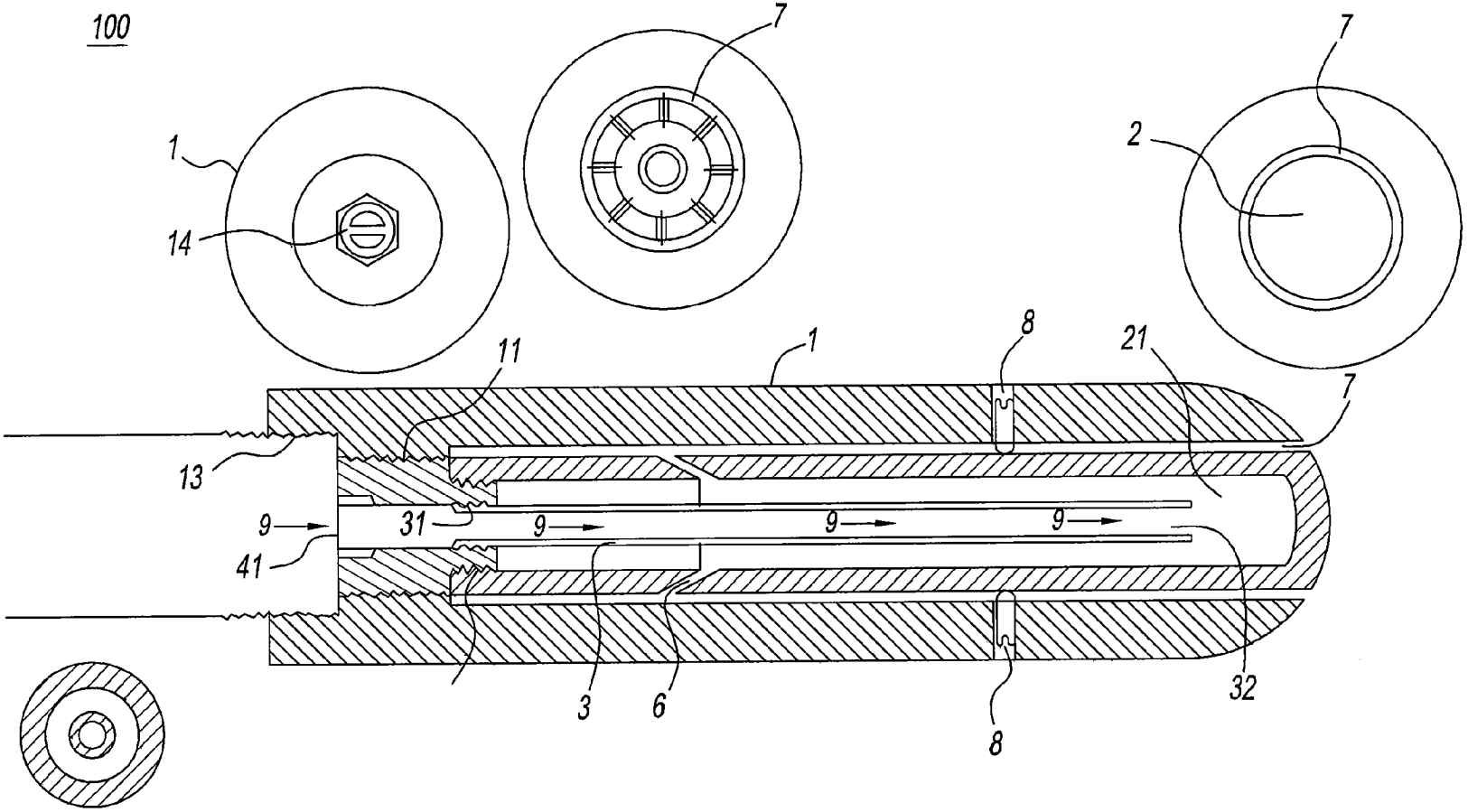
FIG. 1 is an AEPB nozzle according to one embodiment of the present disclosure.

The Atmospheric Electron Particle Beam (AEPB) is a Radio Frequency electron particle beam that is directed into the atmosphere by an electron charged fluid sheath emitted from a nozzle without an enclosed vacuum chamber. The AEPB is not a plasma beam or a helium electron beam torch. Rather, electrons in the AEPB are streamed into the atmosphere from the nozzle having an electrode emitter. A fluid, such as atmospheric air, an inert gas, hydrogen, or a hydrocarbon, is introduced into the nozzle via a fluid input, thereby introducing fuels that are available in the atmosphere. Gases that do not dissociate into poisonous species may be used without regard to operator safety. Humidity-supplemented air is usable at a humidity of up to about 80% relative humidity without regard to water saturation of equipment. Likewise, humidity-supplemented gases, such as humidity-supplemented helium, are useable. A contemplated use of the AEPB is to direct the AEPB onto suitable energy-absorbing targets, such as ZrO-type and aluminum oxide-type ceramics. Aluminum oxide-type ceramics are particularly preferred as targets in boiler systems. Also suitable are magnesium oxide-type ceramics. Either may operably be disposed in boilers. That is, such contemplated use of the AEPB takes place in environmental conditions of temperature and pressure typical of boilers. Any ceramic or composite material may act as a suitable target of an AEPB, provided that a proper combination of AEPB power, RF frequency, fluid flow, and fluid selection are employed.

The operational summation algorithm for operation of a AEPB system driven by a radio frequency inductive capacitive transformer (RFIC) is:

$$o \ll p \ll eo \ll \text{electron beam} \ll M_w = k_f \nu$$

where o is the RFIC's output, p is the nozzle's electron charged fluid sheath frequency, which is higher than the o generator output, and eo is the electron frequency, still higher, that forms the electron beam within the electron charged fluid sheath. The term $M_w = k_f \nu$ is a hypothesis that indicates that all the terms on the left in the algorithm are converting mass to low frequency radiation in the target. The term $k_f$ is the constant that electromagnetic energy traverses and ν (nu) its frequency. Thus, the higher the frequency of the nozzle output the higher is the energy of the nozzle output. The eo of the AEPB system of the present disclosure spans a range of from about $10^5$ to about $10^9$ Hz. Energies corresponding to eo are equal to (hf), where h is Planck's constant, and f is frequency in Hz. When the AEPB reaches an electron scattering point in the atmosphere the AEPB becomes an atmospheric electron charged cloud (AECC).

This is accomplished by use of a solid-state RF sine wave generator at pre-assigned FCC bands, by way of nonlimiting example from about 5 MHz to 80 MHz, e.g., about 13.56 MHz. Though a frequency of about 13.56 MHz±0.005% is preferred, nevertheless it is within the invention to use a frequency range encompassing the $10^5$ to $10^9$ Hertz band of the electromagnetic spectrum. RF energy o is connected to a specially designed inductive capacitive transformer. The inductive capacitive transformer is designed to step-up (transform) 52-Ohm low voltage 500 volts root mean square (RMS) ten amperes high current RF output to higher 5,000 volt (one ampere), though the transformer is not limited to this current/voltage output. RF voltage must be high for a given RF current, since a high RF voltage is required for emission of a stream of electrons from a cold cathode. A return electrical circuit to the RFIC is not required.

The RFIC transformer steps up RF voltage and lowers the RF sine wave current (maintaining the same power) at its output, thereby giving the electrons emitted from an attached electrode an energy and speed sufficient to enter the atmosphere, without early scattering. Setting output voltage is important, for below a voltage of about 500 Volts RMS, an undesirable plasma will be produced. Without confining the application to a particular theory of operation, it is necessary for the RFIC to output a high voltage, while maintaining low current, in order to create an atmospheric electron particle beam without resorting to use of a vacuum chamber or creating a plasma. An RFIC transformer of the present disclosure lacks a ferrous core, and provides a single primary winding. A characteristic of such an RFIC is that it matches a load to an RF generator connected thereto. RFICs have both a primary and a secondary circuit on a coil having a number of turns; the first turn of the coil is the primary circuit, and the rest of the turns are the secondary circuit. A further characteristic of RFICs is that during operation they reflect little power back to an attached RF generator. More turns of the coil produce correspondingly higher voltage output.

The AEPB nozzle, which in an embodiment is designed with an electrode that is a cold cathode, emits an electron beam into the atmosphere with the beam itself sheathed in an electron charged fluid sheath. The electron charged fluid sheath is in the nature of a tube and keeps atmospheric oxygen outside of the AEPB. In practice, the AEPB has been projected through such a sheath over a distance of about 1 meter. However, in theory, by adjusting flow of the fluid and RF input to the AEPB nozzle, the AEPB can be so projected to a distance of from about $10^{-1}$ m to about $10^3$ m.

A fluid, which can be, for example, atmospheric air, is passed through a low voltage high current point of a tube (Cu, with optional Ag plating) within a larger Cu transformer coil within the RFIC, so as to communicate the fluid to the AEPB nozzle or cold cathode. The fluid is, in operation, communicated to the AEPB nozzle as an electron charged fluid. From the cold cathode the AEPB eo is emitted. As used herein, the term "fluid" means a substance that flows; non-limiting examples of a fluid are air, humidified air, helium, hydrogen, and hydrocarbons (e.g., propane), and water. The nozzle's cold cathode remains relatively cool during operation, thus it is unnecessary to protect the cold cathode against oxidation with inert gas. The cold cathode electrodes do not erode measurably during operation, as atmospheric air outside the AEPB (i.e., outside the electron charged fluid sheath) cannot interact (such as by oxidation) with the cold cathode electrodes. Atmospheric air that penetrates the plasma sheath will dissociate, thus reducing or eliminating oxidation of the electrodes.

The nozzle is designed to emit the AEPB with a variable focus. The variable focus is adjusted by turning a surface of the cold cathode electrode, thereby changing a position of the electrode within a nozzle body that encloses it. Further, the design of the nozzle obviates a need for a separate inner smaller copper tube to convey an inert plasma sheath gas (such as He).

Energy content from dissociation of atmospheric air, and volatiles introduced to the AEPB supplies extra energy above that electrically supplied by the RFIC. Placing the AEPB in communication with a ceramic refractory target effects a substantial temperature increase in the ceramic refractory target. A preferred ceramic refractory target is a very high melting point zirconium oxide ceramic manufactured by Zircar Zirconia Inc., of Florida, N.Y., US. Other ceramics may be selected from the group consisting of: Alumina 99.9%, aluminum nitride, boron nitride, silicon carbide, composite, Lava Grade A, Macor, Mulite, quartz, sapphire, silicon dioxide, silicon nitride, zirconia, Steatite L-5, US Refractories Superceram, and Alcast-99. Other custom extruded industrial ceramics from various manufacturers are suitable, such as composite radiant tubes (INEX Inc. NY), zirconia board type ZYZ-3 (Zircar Zirconia Florida, N.Y.). Conventional fire brick and roofing red tiles are functional as well.

A contemplated use of the AEPB is to effect a heating from a distance of targets, e.g., boiler heat exchange surfaces. Non-metal targets, e.g., ceramics, are preferred, for at least the reason that metal targets, if they be of greater than a small size, act as antennae and thus wastefully re-radiate AEPB energy. Composites, also, may be suitable targets. Nonlimiting examples of suitable composite materials are ceramic composites. It is a characteristic of the nozzles of the present disclosure that during operation the nozzles remain cool relative to the target to be heated. Heating of the target, in turn, is modulated by adjustment of RFIC power output, flow of fluid through the nozzles, RFIC output frequency, distance to the target. Selection of target materials, too, has an influence on the success of heating with an AEPB. Without limiting the present disclosure to a particular theory of operation, it is believed that selection of a target material that is capable of resonating at an output frequency of the RFIC is advantageous. It is also contemplated to employ the AEPB to dissociate pollutants and products of combustion that are present in stack emissions, thereby realizing energy gains from such products while eliminating or reducing their environmental impact.

A further contemplated use of the AEPB and AECC is to exploit non-polluting fuel from the atmosphere or from other fluids or solids. An AECC is not the product of oxidation (combustion) but is a product of dissociation of compounds, such as water vapor, air, hydrogen, or propane gas, introduced therein. If propane is used, hydrogen is dissociated therefrom in the AECC. This addition of dissociated hydrogen adds greatly to a heating capability of the AECC on a ceramic target. In a preferred embodiment, the AEPB and AECC operate in an environment at approximately 1 atmosphere, i.e., ≈100 kPa. However, it is possible to operate the AEPB and AEPB at any environmental pressure within about 10 atmospheres, i.e., ≈1000 kPa, provided that the electron charged fluid sheath can be maintained.

A reduction of reflection of power back to the RFIC is also an important feature of the RFIC transformer. This is accomplished by several means: a first control input dial, and an output control dial, both of which are situated on the RFIC transformer. The two control dials remember a number of turns of a coil (see FIG. 5) in both an inner and outer display. The dials are attached to shafts of variable high voltage vacuum capacitors in a circuit of the RFIC transformer. This transformer circuit enables the input to the AEPB electrode electrically to be at the highest RF voltage, and at the correct current to permit the AEPB electrode to emit an atmospheric electron particle beam or stream. This operating voltage-current relationship is critical and is unexpectedly quite different from the prior art.

The AEPB needs no return circuit, and emits an atmospheric electron charged cloud after the beam's electrons are scattered into the atmosphere subsequent to contacting a target. The AEPB together with its scattered atmospheric electron charged cloud is a source of heating or melting of all known ceramics.

FIG. 1 is an AEPB nozzle 100. AEPB nozzle 100 is in four machined parts which are shown dissembled in FIG. 2. AEPB nozzle 100 provides a main nozzle body 1.

In an embodiment, main nozzle body 1 is machined from a solid copper billet, has a substantially circular cross-section, and is highly polished.

Main nozzle body 1 is threadedly engaged to a first thread 10 of a base plug 4. It is also contemplated that main nozzle body 1 may be engaged other than by threading to base plug 4. By way of nonlimiting example, such engagement could be by a pressed-fit fitting, an adhesive, a weld, or other suitable fasteners. AEPB Nozzle 100 is engaged via a flange 13 to a RFIC (not shown).

In turn, a second end of base plug 10 is threadedly engaged to a threaded portion 11 of main nozzle body 1. Engagement other than by threading, such as, for example, by welding, adhesive, pressed-fit fitting, or other fasteners, is also contemplated.

Main nozzle body 1 provides mounting positions for a plurality of allen screws 8 disposed therethrough, and at 120-degree intervals around main nozzle body 1. Allen screws 8 engage cold cathode electrode 2. Cold cathode electrode 2 is threadedly engaged to a second thread 11 of base plug 4. In a preferred embodiment, cold cathode electrode 2 is concentrically disposed within main nozzle body 1.

Main nozzle body 1 and cold cathode electrode 2 are flush. However, a position of cold cathode electrode 2 relative to main nozzle body 1 can be changed by adjustment of a slotted screw 14. Such adjustment changes a focus of output of fluid 9 by raising or lowering cold cathode electrode 2.

RF electrical power input from an RFIC is coupled to AEPB nozzle 100 at flange 13. Flange 13 is a threaded full standard 1-inch flange of copper. Flange 13 is a member that is in electrical communication with cold cathode electrode 2 as the RF electrical power input. Flange 13 is also a member that is in fluid communication with center fluid inlet tube 3 that is disposed within cold cathode electrode 2. Center fluid inlet tube 3 is hollow. Thus, an electron charged fluid 9 can pass through flange 13, through center fluid inlet tube 3, and exit from an end 32 of center fluid inlet tube 3. Cold cathode electrode 2 has fluid transfer holes 6 therethrough, thus placing an internal chamber of cold cathode electrode 2 in fluid communication with an output chamber 7 of cold cathode electrode 2, which chamber is in the nature of a lumen within main nozzle body 1.

In operation, passage of electron charged fluid 9, which can be an inert gas, atmospheric air, gaseous products of combustion, or another fluid, is important in formation of a sheath of the AEPB, and prevents oxidation of cold cathode electrode 2.

Figure 2:
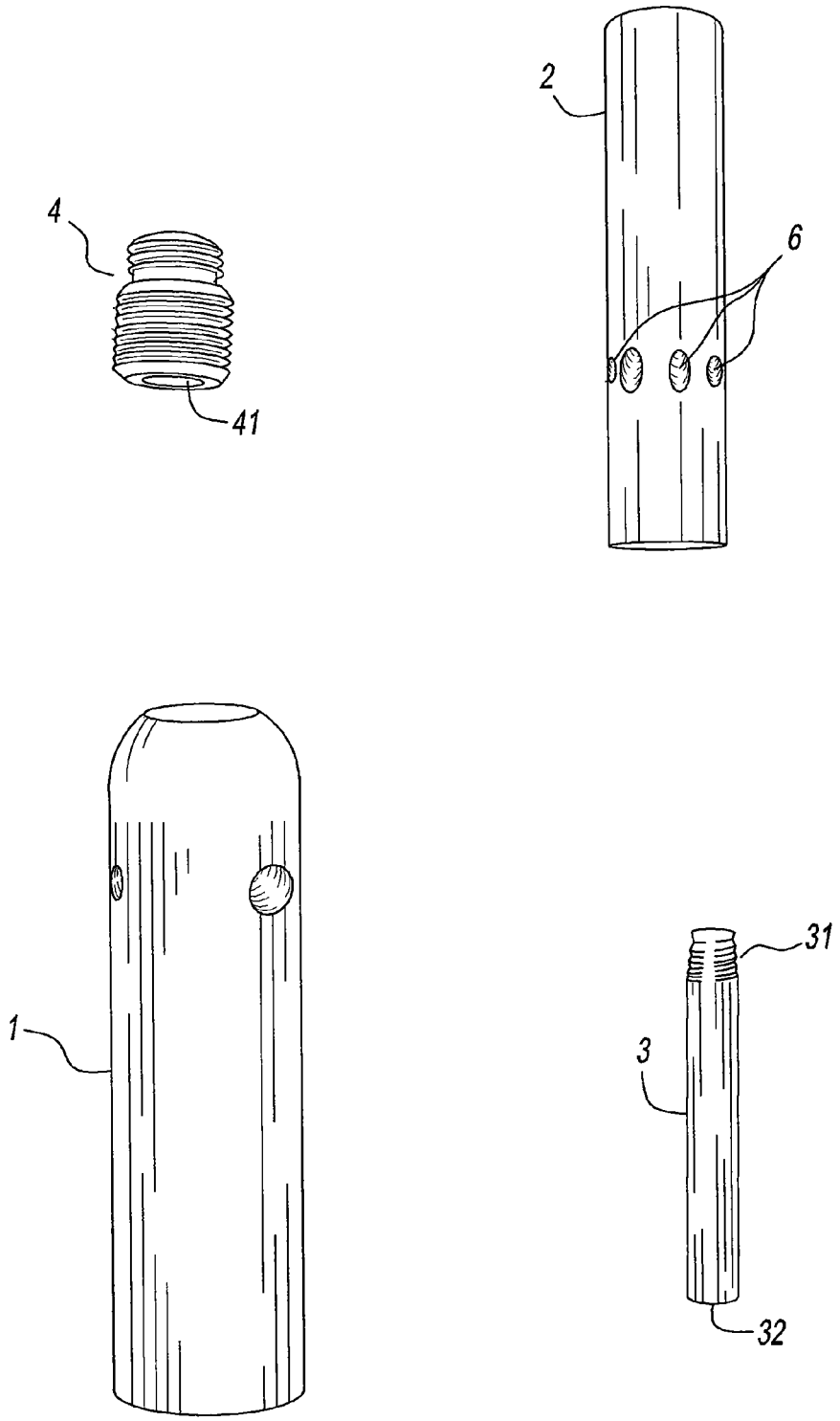
FIG. 2 is the AEPB nozzle of FIG. 1 dissembled into component parts.

FIG. 2 shows AEPB nozzle 100 dissembled into its component parts, main nozzle body 1, cold cathode electrode 2, center fluid inlet tube 3, and threaded plug 4. Threaded plug 4 provides a focus slot 41, a first thread 10 and a second thread 11.

Center fluid inlet tube 3 is substantially cylindrical in cross-section, and has a first inlet tube thread 31 that is sized and adapted to engage first thread 10 of threaded plug 4. An end of center fluid inlet tube 3 describes an opening 32.

Figure 3:
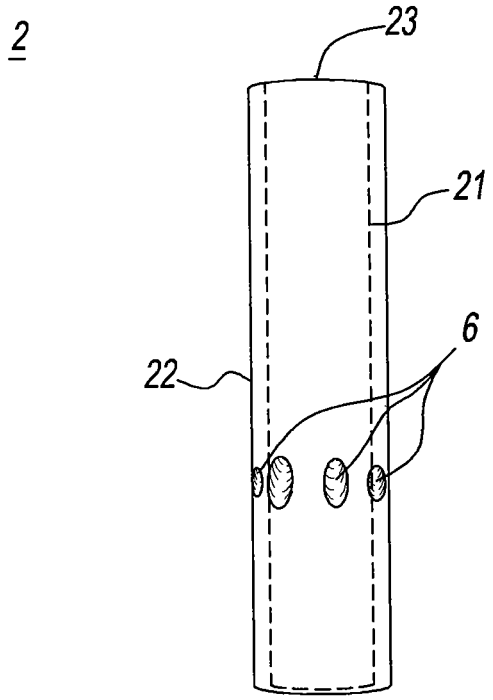
FIG. 3 is a cold cathode copper electrode of an AEBP nozzle.

FIG. 3 is a cold cathode electrode 2 of an AEBP nozzle 100. Cold cathode copper electrode 2 is substantially cylindrical in cross-section and defines an inner space 21 has a plurality of fluid transfer holes 6.

Fluid transfer holes 6 are at an angle substantially less than perpendicular to a long axis of cold copper cathode electrode 2, and penetrate from an outer surface 22 of cold copper cathode electrode 2 into inner space 21. Thus, it can be said that outer surface 22 and inner space 21 are in fluid communication.

Outer surface 22 and inner space 21 are separated by a thickness within the range of about 0.025 inches to about 0.1 inches, for example 0.051 inches. A distal end 23 has a thickness in the range of about 0.125 inches to about 0.375 inches, for example 0.25 inches.

When assembled as part of AEBP nozzle 100, cold cathode electrode 2 and main nozzle body 1 describe output chamber 7 that is annular in cross-section. In an embodiment, output chamber 7 has a dimension of from about 0.75 inches to about 1.25 inches, for example about 1 inch, depending on an intended operational power of AEPB nozzle 100.

AEPB nozzle 100 is operated when an RF source and source of electron charged fluid 9 are connected. In an embodiment, electron charged fluid 9 is generated by supplying a fluid, e.g., air, or hydrogen, to the RF source, for example an RFIC (see FIGS. 5 and 5A), which converts the fluid into electron charged fluid. The electron charged fluid is introduced to nozzle 100 under pressure, circulating therethrough, and is forced out through output aperture 7. In an embodiment, output aperture 7 is disposed concentrically around electrode 2. In this way, when application of the RF source to electrode 2 causes an electron beam to be emitted from electrode 2, the electron beam is disposed within a sheath of electron charged fluid 9. The RF source is tuned to supply RF to nozzle 100 at a frequency, voltage, and amperage that are, taken together with the flow of electron charged fluid 9, suitable for such emission of the electron beam.

Figure 4:
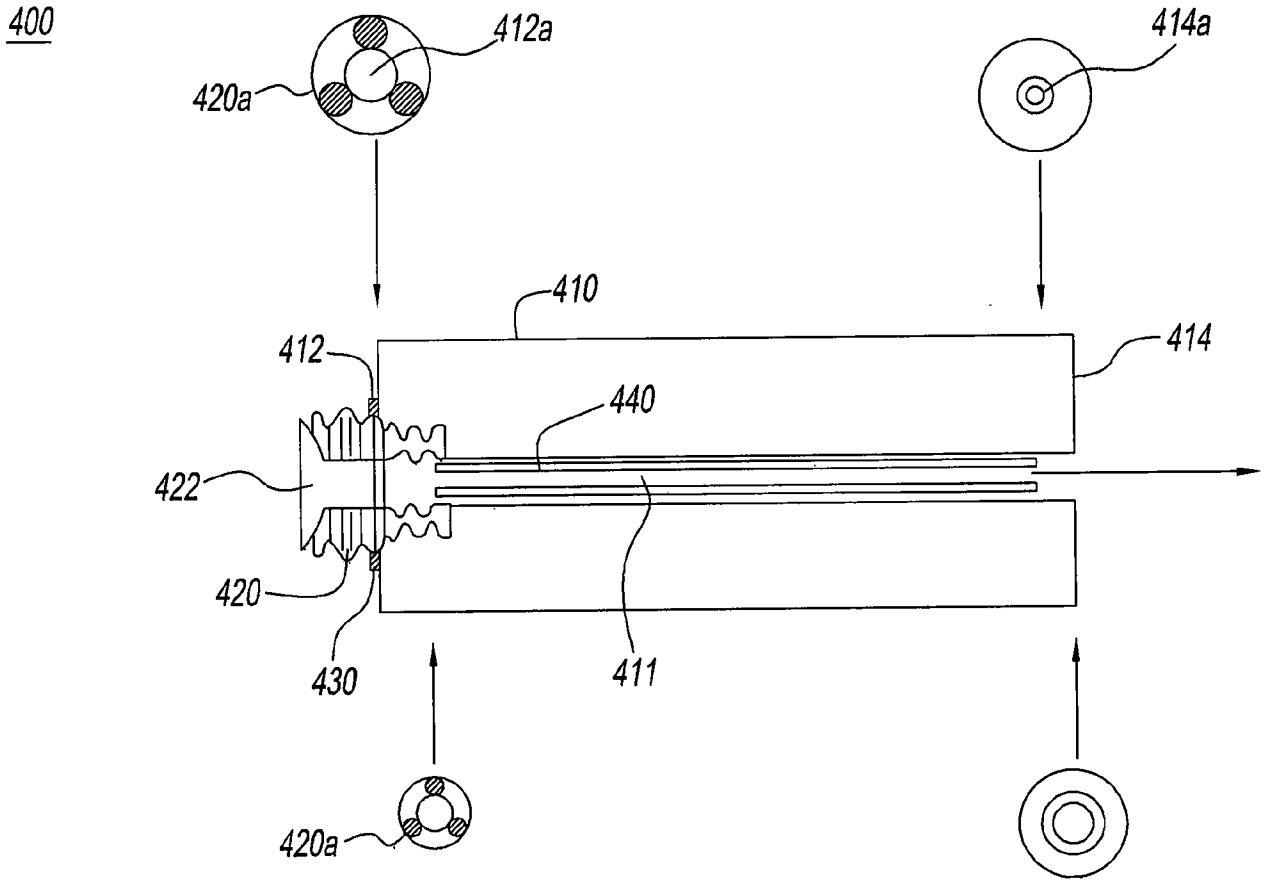
FIG. 4 is a boron nitride AEPB nozzle.

FIG. 4 shows a boron nitride AEPB nozzle 400. AEPB nozzle 400 provides a nozzle body 410.

Nozzle body 410 is of a ceramic material, preferably a boron nitride (BN) ceramic. In a preferred embodiment, nozzle body 410 is shaped by machining. Nozzle body has a first end 412, a second end 414, and a hollow cylindrical lumen 411 disposed along a long axis between first and second ends 412 and 414. A base aperture 412*a* is disposed at first end 412. An output aperture 414*a* is disposed at second end 414. A diameter of base aperture 412*a* is greater than a diameter of output aperture 414*a*.

First end 412 is sized and adapted to receive threadedly a threaded screw base 420. Preferably, threaded screw base 420 is machined from tungsten. Disposed along a central axis of threaded screw base 420 is a fluid input 422, which is tubular, and which, when fitted to nozzle body 410, interfaces non-occlusively with cylindrical lumen 411. A centering element 430 allows centering of threaded screw base 420 with nozzle body 412. A suitable centering element 430 is a copper washer. Disposed parallel to but not along a central axis of screw base 420 are a plurality of tubular fluid holes 420*a* that are in fluid communication with fluid input 422.

Threaded screw base 420 is sized and adapted to receive an electrode 440. Electrode 440 is of hollow cylindrical cross-section, and is sized to fit within cylindrical lumen 411 of nozzle body 410. Electrode 440 is mounted to threaded screw base 420. It is preferred that electrode 440 be machined from tungsten.

In operation, electrode 440 is in electrical communication with an RFIC (not shown), and in fluid communication with a source of fluid input (not shown) to fluid input 422.

AEPB nozzle 400 operates according to substantially the same principles as AEPB nozzle 100. However, aperture 414*a* is of such a small diameter that AEPB nozzle 400 emits an AEPB that is very sharp and focused, and that is useful for melting or vaporizing small spots of target material. Though in a contemplated embodiment aperture 414*a* is for sharp and focused output, AEPB nozzle 400 nevertheless can be scaled up to provide a larger AEPB.

Figure 5:
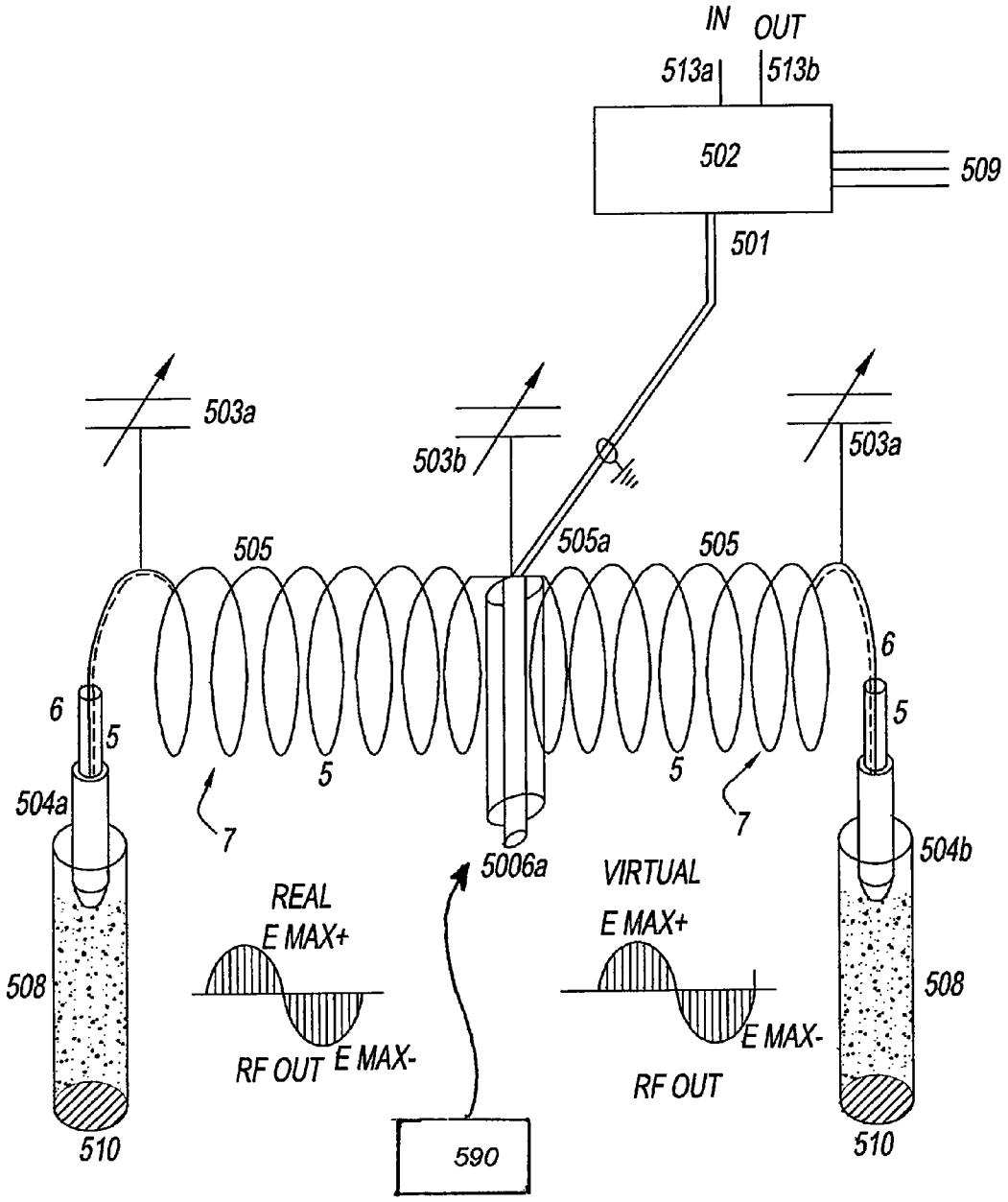
FIG. 5 is a system comprising a RF inductive capacitive (RFIC) transformer and Electron Beam Nozzles according to the present disclosure.

FIG. 5 is a system 500 comprising a RF inductive capacitive transformer, fluid source, and EBNs.

System 500 includes RF generator 502, which is a solid-state 90-pound RF generator that is auto and manual controlled with a 5000-watt output at a frequency between about $10^5$ Hz to about $10^9$ Hz. RF generator 502 is preferably operated from about 5 MHz to 80 MHz. More preferably, RF generator 502 is operated at 13.56 MHz±0.005%. As used herein, "about 13.56 MHz" means 13.56 MHz±0.005%.

Output of RF generator 502 is connected via coaxial RF cable 501 to a transformer coil 505A at a center point of a coil 505 and this output serves as input to tubular transformer coil 505. This input from RF generator 502 is at a voltage of 500 volts RMS, and a frequency of about 13.56 MHz±0.005% at a current of ten amperes. This is known as the 52-Ohm input from RF cable 501.

Vacuum variable capacitors 503A and 503B are connected to a center and outside points of transformer coil 505.

Transformer coil 505 has a right virtual and a left real operating half, which enables system 500 to operate either in the virtual half (one nozzle load) or in the real half on nearly the same atmospheric air fuel and RF output of RF generator 502.

System 500 provides two nozzles 504A, 504B corresponding to virtual and real halves of system 500. Nozzles 504A, 504B could be a nozzle 100, or AEPB nozzle 400. In a sense nozzles 504A, B are mirror images of one another. As the real and virtual halves are essentially reflections of one another, the virtual half operates at nearly free energy as supplied to the real half.

Transformer coil 505 is silver plated internally and/or externally. and its turns can be so designed to increase input voltage at location 505A and reduce the output current at location 506A. A first turn of transformer coil 505 acts as a primary circuit, and remaining turns of transformer coil 505 are a secondary circuit. The more are the turns of transformer coil 500, the more the output current is reduced, with concomitant increase of output voltage. Because to achieve a proper output voltage is instrumental in generating an AEPB and its electron charged fluid sheath, which is in turn instrumental for projecting electron beams according to the present disclosure, the turns and construction of transformer coil 500 should be made of a material having high electrical conductivity.

Input voltage can be increased by adding additional turns to transformer coil 505. Variable vacuum capacitor 503*b* is tuned to set input voltage matched to 52 Ohms (500 Volts 10 Amperes) at location 505A to output at location 506A. In system 500, each additional turn of transformer coil 505 raises the output voltage by about 500 to about 1000 Volts RMS. Attaining a suitable output voltage permits formation of an electron charged fluid sheath, which in turn is advantageous because into such a sheath compounds may be introduced for dissociation. Such dissociation increases substantially overall energy output of an AEPB. Location 506A is a low-voltage, high-current point of transformer coil 505. At location 506A a fluid, e.g., atmospheric air, hydrogen, or propane, is introduced into transformer coil 505, and the fluid during operation of RF generator 502 is excited by the output voltage and RF frequency to form electron charged fluid 9. Electron charged fluid 9 is, in turn, supplied during operation to an attached nozzle, e.g., nozzle 100 or AEPB nozzle 400.

A ceramic refractory load 508 serves as a target in system 500. Ceramic refractory load 508 is, for example, a high melting-point heat conducting ceramic or refractory tube, plate, or rod.

Generator 502 receives as input 509 three-phase 208V power. Though any three-phase 208V source is suitable, the source could main power (not shown) or a wind generator (not shown).

Ceramic refractory load 508 is sealed at an end 510, as the mass of atmosphere and water vapor has been dissociated and converted to radiation by the EPB Nozzle so there is no exhaust as in combustion burners. Thus, ceramic refractory load 508 is closed, which is an energy saving factor; the atmospheric electron charged cloud's energy would otherwise enter the atmosphere and be lost to the refractory load.

A fluid source 590 supplies fluid to nozzles location 506A at positive pressure during operation. The fluid can be, for example, atmospheric air, hydrogen, propane, or a fluid having pollutants dispersed therein, or a combination thereof.

Figure 5A:
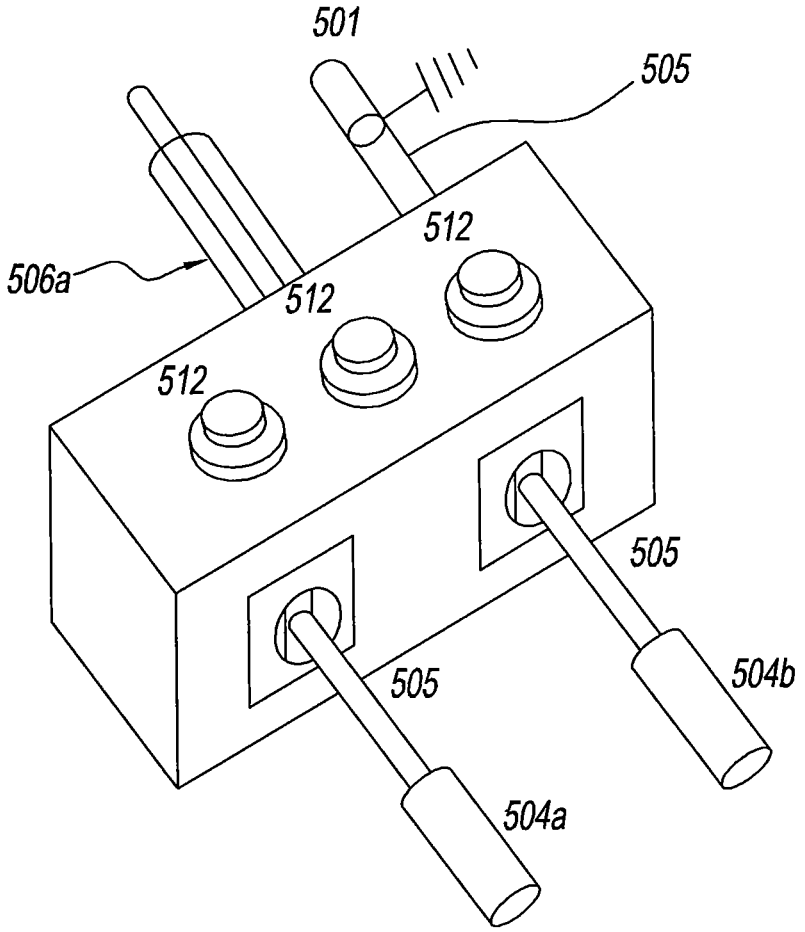
FIG. 5*a* is a solid state generator.

FIG. 5A shows generator 502 including controls therefor. Generator 502 provides Vernier dials 512 to keep track of where variable vacuum capacitors 503*a*, 503*b* are set for proper operation of one or more ceramic refractory loads 508.

RF generator 502 provides water cooling input and output 513A, 513B. Heat energy extracted by water cooling could also usefully reclaimed for another use. For example, the heat could be used to pre-heat fluid in cool fluid sink 750 (FIG. 7).

FIG. 6 is a table of the electromagnetic spectrum. RF input to the AEPB nozzle of the present disclosure is preferably supplied at from about 5 MHz to about 80 MHz, most preferably at 13.56 MHz±0.005%, which corresponds to an energy of approximately $10^{-8}$ eV. Notably, the output of the AEPB with the supplied fuel is at an energy of approximately $10^{1}$-$10^{2}$ eV. Significantly, this represents a stepup of at least about 9 orders of magnitude in electron volts. Radiation emitted from various targets of the AEPB is at a frequency of from $10^{12}$ Hz to $10^{15.5}$ Hz.

Figure 7:
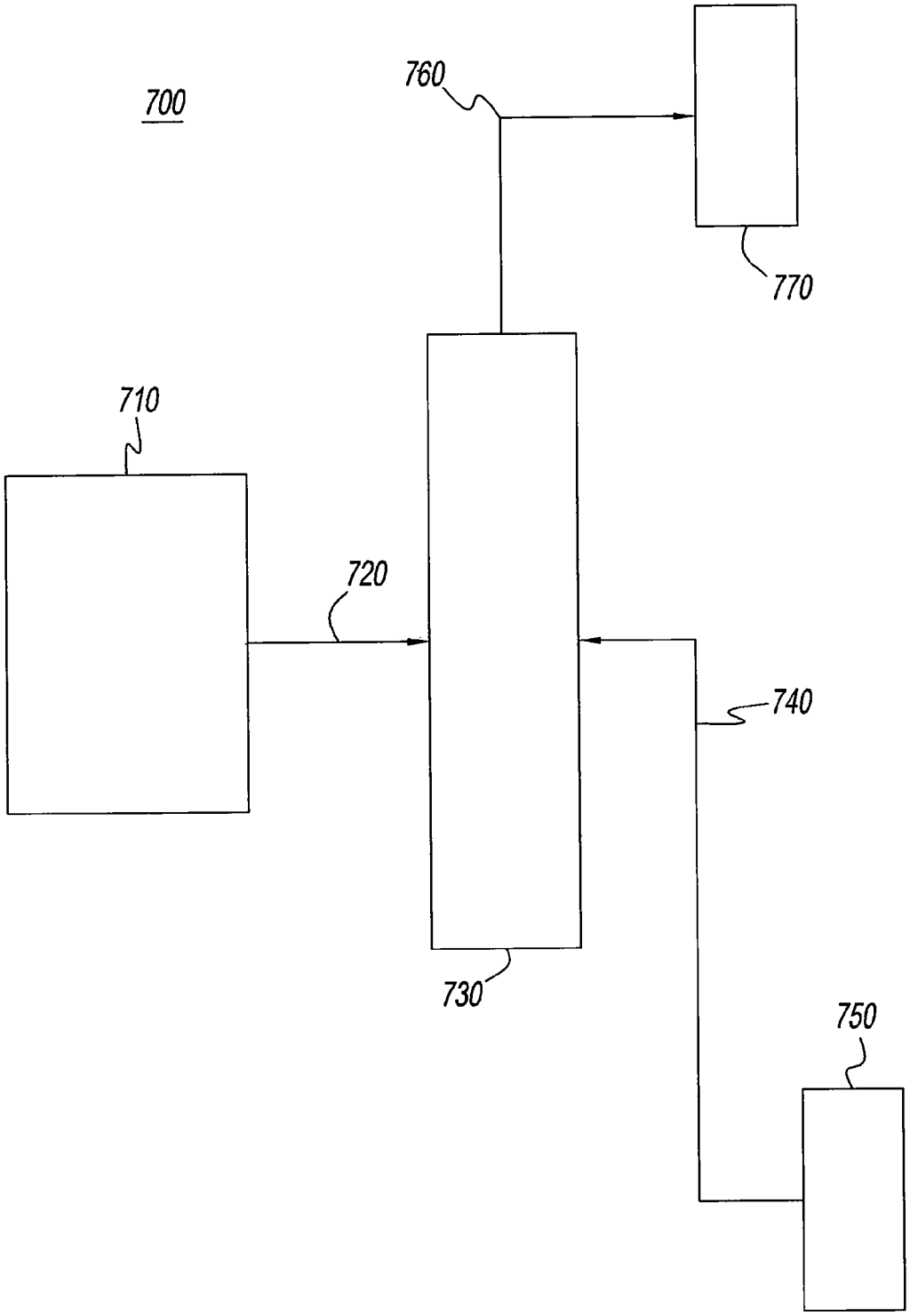
FIG. 7 is a boiler system.

FIG. 7 is a boiler system 700. An AEPB 710 emits an AEPB or atmospheric electron charged cloud 720 that is directed at and heats a suitable target 730. Preferably, target 730 is a ceramic non-metallic target or reaction vessel, because metallic targets of AEPB 710 tend to act as antennae and re-radiate AEPB energy wastefully. Target 730 receives an input of cool fluid 740 from cool fluid sink 750. Heat that is added to target 730 by AEPB 710 is transported away from target 730 as warm fluid 760, and conveyed to hot fluid sink 770. Accordingly, during operation of boiler system 700 there will develop a heat gradient across cool fluid sink 750 and hot fluid sink 770, which gradient can be used to perform useful work. Tests have shown that there is no RF radiation from the operation boiler on atmospheric electron particle beam directed into the proper ceramic tube within the operation boiler. Also, there is no pollutant gas or smoke as in prior art combustion heating burners. There is no need for oxygen inside the boiler, since the atmospheric air fuel is provided in the fluid sheath. There is no RF radiation from any metal constructed heater of whatever type utilized for AEPB ceramic heating.

WORKING EXAMPLES

Example 1 a full three-foot long boiler ceramic heating tube was heated along its full length by the AEPB system, whereby the boiler's stack could be closed off and the AEPB ceramic (Zirconium oxide and Aluminum Oxide heated target) could operate with out the need for an air outlet. This is something that a prior art gas or oil fueled burner could not do as they both need oxygen and an exhaust port. The AEPB boron nitride nozzle and its tungsten electrode ran for 3 to 4 hours without any electrode or nozzle damage and no carbon dioxide or other pollutants output. There was no need of an additional fan to move air. AEPB power input was about 4500 watts at 13.56 MHz.

Example 2 a nozzle according to FIG. 1 operated at 3 to 5000 watts input from the RFIC for a ten minute period on 12 cubic feet per hour of atmospheric air directed as fuel for the AECC at a 2700 F melting point fire brick. An end portion of the fire brick turned red hot in the AECC. When the compressed air was increased, the AECC got much hotter and caused the brick's temperature to increase greatly; eventually the brick attained white heat and reached a melting point, forming a large drop of lava like glass when cooled to room temperature.

Example 3 the nozzle of FIG. 4 was operated using helium as a supplied fluid. The resulting AEPB was directed into a room, vertically. The blue electron beam portion was about three inches long and 0.25 inch wide then it branched out into the AECC and it length was over three feet long vertically with a width of two or more inches, staying stable white in color (measures no temperature). When a large piece of wood 6×0.5×10 inches long was inserted into the AECC column it burst immediately into to a large burning (no smoke) flame (coloring the ballooning AECC into a red color of hot air), and then when the burning wood was removed from the AECC (which by now ballooned out to over a foot wide) continued to burn in the oxygen room atmosphere and emitted large amounts of black smoke. When the wood was placed back into AECC, the smoke was gone and the wood continued to color the cloud with fire and red colors.

Example 4 propane gas was introduced to nozzles according to FIG. 1 or 4 with either air or helium driven, at an RFIC Transformer output of about 3000 W. The propane dissociated to liberate hydrogen into the AEPB and this hydrogen added considerable more heat energy to the AEPB. The dissociated atmospheric gases introduced to the AEPB nozzles do the opposite sending clean oxygen molecules into the atmosphere and removes the carbon, or other pollutants and converts them to stored energy in ceramics or traps them in ceramics or example sand $SiO_2$.

Example 5 a nozzle according to FIG. 1 was operated, in a vertical orientation, with about 25 cubic feet per hour of atmospheric air. During operation under these conditions, a three foot long by one foot wide AECC was produced. AECC temperature measurement showed no heat measured in the infra red to red spectrum, but the AECC was visible. There was no damage to the nozzle, which remained cool during operation. As soon a ceramic or other target was introduced into the AECC, the target heated within 1-2 seconds to beyond the target material's melting point.

Example 6 a nozzle according to FIG. 4 was operated at a power input of 2000 W, using atmospheric air as fluid input. An AEPB emitted under these conditions was directed into the side of a 3×0.25×6 inch closed cylinder of zirconium oxide ceramic for one second. A crack defect in the cylinder was welded together by the AEPB at a temperature above 4400 F. The same AEPB nozzle, operating at one thousand watts and 13.56 MHz, would heat the entire cylinder to white light. After 3 minutes, when the power was upped to 2500 watts, the entire cylinder turn red hot. Radiant heat was perceptible by observers at distinctness of three to six feet.

The techniques described herein are exemplary, and should not be construed as implying any particular limitation on the present invention. It should be understood that various alternatives, combinations and modifications could be devised by those skilled in the art. The present invention is intended to embrace all such alternatives, modifications and variances that fall within the scope of the appended claims.

What is claimed is:

1. An atmospheric electron particle beam nozzle, comprising:

a nozzle body having a lumen disposed therethrough; and an electrode that is disposed within said lumen to define an output chamber within said lumen that encompasses said electrode, wherein said output chamber is disposed between adjacent surfaces of said nozzle body and said electrode.

2. The atmospheric electron particle beam nozzle of claim 1, further comprising: a fluid input that is in fluid communication with said electrode; and an electrical input that is in electrical communication with said electrode.

3. The atmospheric electron particle beam nozzle of claim 2, wherein said output chamber is annular in cross section about a distal end of said electrode.

4. The atmospheric electron particle beam nozzle of claim 2, wherein said electrode is in fluid communication with said output chamber.

5. The atmospheric electron particle beam nozzle of claim 4, wherein said electrode is in fluid communication with said output chamber through least one hole disposed through said electrode.

6. The atmospheric electron particle beam of claim 2, wherein said electrode is adjustably positionable within said lumen.

7. The atmospheric electron particle beam nozzle of claim 1, wherein said electrode is disposed within said lumen concentrically.

8. An atmospheric electron particle beam system comprising:

an atmospheric electron particle beam nozzle including a nozzle body having a lumen disposed therethrough and an electrode that is disposed within said lumen to define an output chamber within said lumen that encompasses said electrode;

an RF generator that is in communication with said nozzle; and a fluid source that is in fluid communication with said nozzle, and that supplies said nozzle with a fluid.

9. The system of claim 8, wherein said RF generator produces an RF output in the range between about $10^5$ to about $10^9$ Hertz.

10. The method of claim 9, wherein a portion of said atmospheric electron particle beam is disposed within an electron charged fluid sheath.

11. The system of claim 8, further comprising a transformer that is in communication with said RF generator, wherein said transformer comprises: a coil that is a primary winding; wherein said coil comprises a plurality of turns, and wherein a first turn of said plurality of turns is a primary circuit, and wherein second and further turns of said plurality of turns are a secondary circuit, and wherein said transformer receives RF input from said RF generator at a first voltage and a first current, and produces RF output to said nozzle at a second voltage and a second current.

12. The system of claim 11, wherein each of said second and further turns of said plurality of turns effects an increase of said second voltage and a decrease of said second current.

13. The system of claim 12, wherein said second voltage is in the range from about 500 Volts RMS to about 5000 Volts RMS.

14. The system of claim 12 wherein said fluid from said fluid source passes through said coil before passing through said nozzle, wherein said transformer excites said fluid while said fluid is passing through said coil, thereby forming an electron charged fluid.

15. The system of claim 14 wherein said coil is adapted to supply said electron charged fluid to a nozzle.

* * * * *